US010704776B2

(12) United States Patent
Grandadam

(10) Patent No.: US 10,704,776 B2
(45) Date of Patent: Jul. 7, 2020

(54) SLIDING LIGHT SWITCH WITH INTEGRATED LIGHT SOURCE

(71) Applicant: Promier Products, Inc., Peru, IL (US)

(72) Inventor: Cody Grandadam, Peru, IL (US)

(73) Assignee: Promier Products Inc., Peru, IL (US)

( * ) Notice: Subject to any disclaimer, the term of this patent is extended or adjusted under 35 U.S.C. 154(b) by 0 days.

(21) Appl. No.: 16/195,383

(22) Filed: Nov. 19, 2018

(65) Prior Publication Data

US 2019/0154242 A1 May 23, 2019

Related U.S. Application Data

(63) Continuation-in-part of application No. 29/670,565, filed on Nov. 16, 2018.

(Continued)

(51) Int. Cl.

*F21V 23/04* (2006.01)
*H01H 15/10* (2006.01)

(Continued)

(52) U.S. Cl.

CPC ..... *F21V 23/04* (2013.01); *F21L 4/00* (2013.01); *H01H 15/10* (2013.01); *F21Y 2115/10* (2016.08)

(58) Field of Classification Search

CPC ..... F21V 14/085; F21V 14/08; F21V 17/20; F21V 11/186; F21V 11/18; F21V 11/16;

(Continued)

(56) References Cited

U.S. PATENT DOCUMENTS 2,879,379 A * 3/1959 Lyons ..... A45D 42/12 362/141
4,686,609 A * 8/1987 Dykstra ..... B60Q 3/85 362/141

(Continued)

FOREIGN PATENT DOCUMENTS

| | | |
|---|---|---|
| EP | 2149744 | 2/2010 |
| EP | 2568488 | 3/2013 |
| KR | 2016003934 | 11/2016 |

OTHER PUBLICATIONS

International Search Report and Written Opinion issued to PCT/US2018/061851, dated Jan. 19, 2019, 18 pages.

(Continued)

*Primary Examiner* — Bryon T Gyllstrom
*Assistant Examiner* — James M Endo
(74) *Attorney, Agent, or Firm* — Barnes & Thornburg LLP

(57) ABSTRACT

An illuminating light switch with an integrated sliding member that, when actuated by a user, exposes led lighting elements to illuminate the area where the light switch is affixed. The light switch includes a front member having a light aperture aligned with a light source, a rear member with a first mounting member affixed, a second mounting member adapted to be coupled to both a support surface and the first mounting member, and an internal switch to selectively supply current to the light source. In the closed position, the sliding member obscures the light source and no current is supplied to the light source. In the intermediate position, the sliding member partially exposes a first extent of the light source that provides illumination through the light aperture. In the open position, the sliding member exposes a second extent of the light source to provide a greater amount of illumination through the light aperture.

20 Claims, 8 Drawing Sheets

Related U.S. Application Data

(60) Provisional application No. 62/588,029, filed on Nov. 17, 2017.

(51) Int. Cl.
*F21L 4/00* (2006.01)
*F21Y 115/10* (2016.01)

(58) Field of Classification Search
CPC ..... F21V 11/183; F21V 17/02; F21V 21/145; F21V 23/0414; F21V 23/0428; F21V 23/0471; F21S 9/00; F21S 9/02; F21S 10/023; F21S 10/026
See application file for complete search history.

(56) References Cited

U.S. PATENT DOCUMENTS 4,710,856 A * 12/1987 Cheung ..... B60Q 3/252 296/97.5
5,017,837 A 5/1991 Hanna et al.
5,061,003 A * 10/1991 Gabas ..... B60J 3/0282 296/97.1
5,064,276 A 11/1991 Endo et al.
D336,744 S 6/1993 Kahn et al.
D339,326 S 9/1993 Mayo et al.
5,618,100 A 4/1997 Glynn
5,763,872 A 6/1998 Ness
6,010,228 A 1/2000 Blackman et al.
6,010,235 A * 1/2000 Sawyer ..... B44C 3/12 248/206.5
6,030,094 A * 2/2000 Sedovic ..... F21L 4/00 362/183
6,309,086 B1 * 10/2001 Tomlinson ..... F21V 15/01 362/145
6,520,661 B1 * 2/2003 Hill ..... F21V 21/096 362/249.01
6,572,239 B1 * 6/2003 Harbin ..... F21V 15/01 362/145
6,648,496 B1 11/2003 Elghoroury et al.
6,692,060 B1 * 2/2004 Wilson ..... B60J 3/0282 296/97.1
7,021,788 B2 * 4/2006 Poon ..... F21L 4/00 362/186
7,036,961 B2 5/2006 Defouw et al.
7,165,876 B2 1/2007 Dickie
7,204,614 B2 4/2007 Hanis et al.
7,273,983 B1 9/2007 Rintz
7,506,990 B2 3/2009 Glazner
7,582,828 B2 9/2009 Ryan
7,791,282 B2 * 9/2010 Yu ..... H05B 37/0209 315/209 R
8,003,886 B1 8/2011 Rintz
8,075,149 B2 12/2011 Ko et al.
D652,549 S 1/2012 Pineault et al.
8,247,693 B2 8/2012 Gober
8,622,564 B2 1/2014 Chang et al.
8,646,936 B2 2/2014 Goyal et al.
8,912,442 B2 12/2014 Smith
8,939,601 B1 * 1/2015 Lee ..... F21L 4/00 362/162
D724,035 S 3/2015 Flowers et al.
D751,236 S 3/2016 Renshaw et al.
9,345,110 B2 5/2016 Miller
9,384,657 B2 7/2016 Mullet et al.
9,583,288 B2 2/2017 Jones et al.
D782,986 S 4/2017 Vasquez et al.
D795,203 S 8/2017 Vasquez et al.
9,818,559 B2 11/2017 Tress et al.
10,066,820 B2 9/2018 Johnson
2004/0080932 A1 4/2004 Hata
2005/0012633 A1 1/2005 Yoon
2005/0195594 A1 * 9/2005 Kurtz ..... F21S 9/022 362/184
2005/0237756 A1 * 10/2005 Ogawa ..... B60Q 3/82 362/492
2007/0217211 A1 9/2007 Hewson et al.
2008/0043468 A1 * 2/2008 Kennedy ..... G02B 27/20 362/255
2008/0043471 A1 2/2008 Musgrove et al.
2008/0117623 A1 * 5/2008 Tarter ..... F21L 4/00 362/106
2008/0169176 A1 7/2008 Yang
2008/0266864 A1 * 10/2008 Ryder ..... F21V 14/08 362/282
2010/0033950 A1 2/2010 Farrell
2011/0255274 A1 * 10/2011 Coleman ..... F21L 4/02 362/183
2012/0112641 A1 5/2012 Leshniak
2012/0286940 A1 11/2012 Carmen, Jr. et al.
2013/0107513 A1 * 5/2013 Lundberg ..... F21V 14/04 362/231
2014/0119005 A1 * 5/2014 Jorgensen ..... F21S 10/026 362/231
2016/0248202 A1 8/2016 Smith et al.
2017/0140884 A1 5/2017 Peng

OTHER PUBLICATIONS

Promier—LitezAll COB LED Cordless Light Switch, Oct. 19, 2015.
VIBELITE Tap Light, Magnet Stick-on Anywhere, Amazon, Nov. 5, 2017.
Promier—LitezAll COB LED Jumbo Cordless Light Switch 400 Lumens, Jul. 16, 2016.
Nebo Flipit Contemporary 2 Pack Portable Led Light, Amazon, Jul. 6, 2017.
Dimmable COB LED Cordless Switch Light, Amazon, Aug. 28, 2017.
2 Light Switch Wall Nightlight 8-LED, Amazon, Aug. 17, 2015.
Might Light LED Motion Sensor Night Light, Banggood, Aug. 10, 2012.

* cited by examiner

SLIDING LIGHT SWITCH WITH INTEGRATED LIGHT SOURCE

CROSS-REFERENCE TO RELATED APPLICATIONS

This application claims the benefit of Provisional Patent Application No. 62/588,029, filed on Nov. 17, 2017, and Design patent application Ser. No. 29/670,565, filed on Nov. 16, 2018, which are incorporated in their entirety herein by reference and made a part hereof.

TECHNICAL FIELD

The present subject matter relates to lighting controls, and more particularly, to a light switch with an integrated sliding member that, when actuated by a user, exposes LED lighting elements to provide adjustable levels of illumination to the area where the light switch is installed.

BACKGROUND

Electronic lighting is critical for indoor, outdoor and nighttime activities. Electronic lighting is typically provided from fixed locations, where a light source receives electrical power from a fixed and wired power source. Such lighting is useful in illuminating a particular area, but lacks the flexibility of more portable lighting systems. For example, a user would need to spend a substantial amount of time and money installing additional wiring to support additional lights within a building structure, such as a house or office.

Internally powered portable lighting systems have been developed to provide illumination in more varied locations and situations. However, such internally powered portable lighting systems are not optimized to provide illumination both in fixed locations and in varied locations. Additionally, such internally powered portable lighting systems are not typically aesthetically pleasing and they lack the ability to be easily mounted and re-mounted in various locations. For example, portable lighting systems, such as flashlights, do not typically match the decor of a home or office and they do not illuminate a location not in use.

Accordingly, there is an unmet need for a light switch that can be installed on a wall surface and that is able to provide illumination in a variety of configurations and situations.

SUMMARY

The invention provides an illuminating light switch with an integrated sliding member that, when actuated by a user, exposes LED lighting elements to illuminate the area where the light switch is affixed. The light switching includes an openable housing with a front member that includes a light aperture and a rear member that includes a first mounting receiver that receives an extent of a first mounting member. A second mounting member is adapted to be releasably coupled to both the support surface, such as a wall, and the first mounting member;

A sliding member is operably connected to at least one internal channel of the housing. The sliding member is movable along the channel between a closed position, an intermediate position and an open position. A light source is disposed between an extent of the rear member and the sliding member, wherein the light source is aligned with the light aperture. However, the light source lacks reflector, lens or optic. At least one power source is operably connected to an internal switch to selectively supply current to the light source depending upon the position of the sliding member, as articulated by the user of the switch.

In the closed or off position, the sliding member obscures the light source and the internal switch does not supply current from the power source to the light source for illumination. In the intermediate or partially on/partially off position, the sliding member exposes a first extent of the light source and the internal switch supplies current from the power source to the light source for illumination through the light aperture. In the open or fully on position, the sliding member exposes a second extent of the light source and the internal switch supplies current from the power source to the light source for illumination through the light aperture. The second extent of the light source exceeds the first extent of the light source, as referenced in this paragraph.

According to other aspects of the disclosure, the first mounting member is a ferromagnetic disk and the second mounting member is a magnet, wherein the magnetic attraction between the first mounting member and the second mounting member releasably secures the illuminating light switch to the support surface. In this manner, the light switch remains in its installed position during normal usage by the operator over time. When the operator decides to relocate the switch to another location—for example, to a second support surface or use the switch to provide portable illumination, the operator applies a disengagement force to the housing to overcome the magnetic attraction whereupon the switch can be disconnected from the second mounting member and the initial support surface.

Other aspects and advantages of the present invention will become apparent upon consideration of the following detailed description and the attached drawings wherein like numerals designate like structures throughout the specification.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be used within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Figure 1:
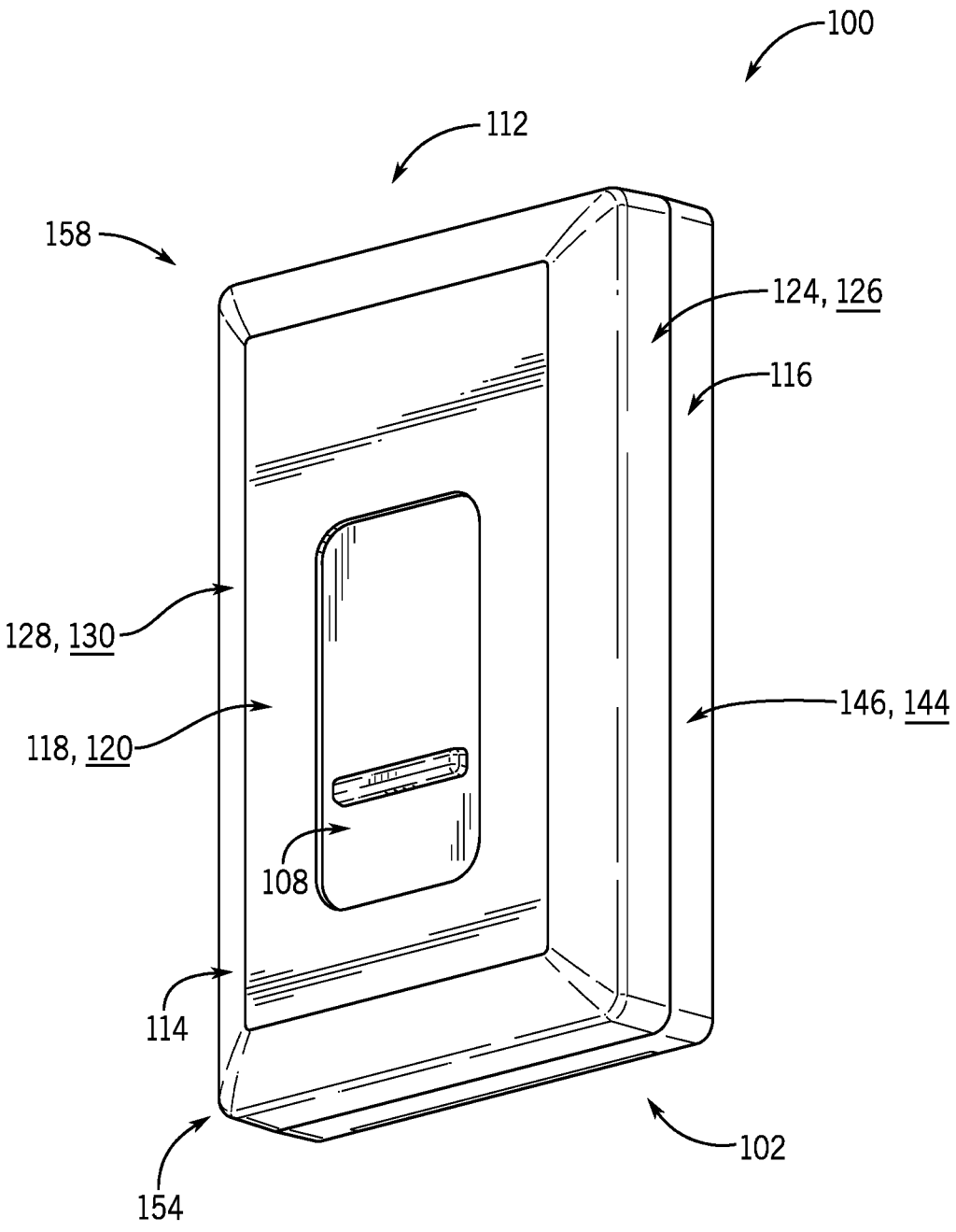
FIG. 1 is a front perspective view of an illuminating light switch with a sliding member in a first position where the sliding member obscures the light source.
Figure 2:
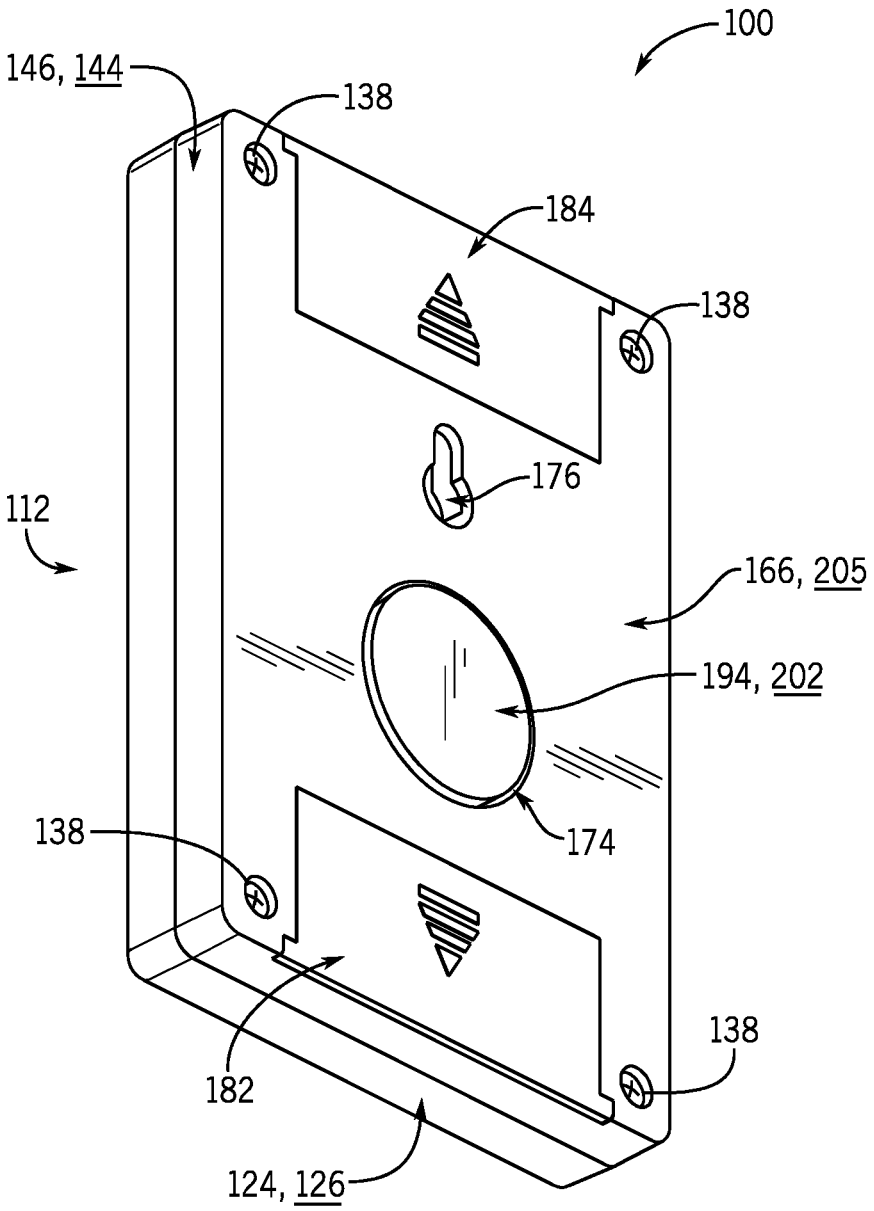
FIG. 2 is a rear perspective view of the light switch.
Figures 3, 4, 5:
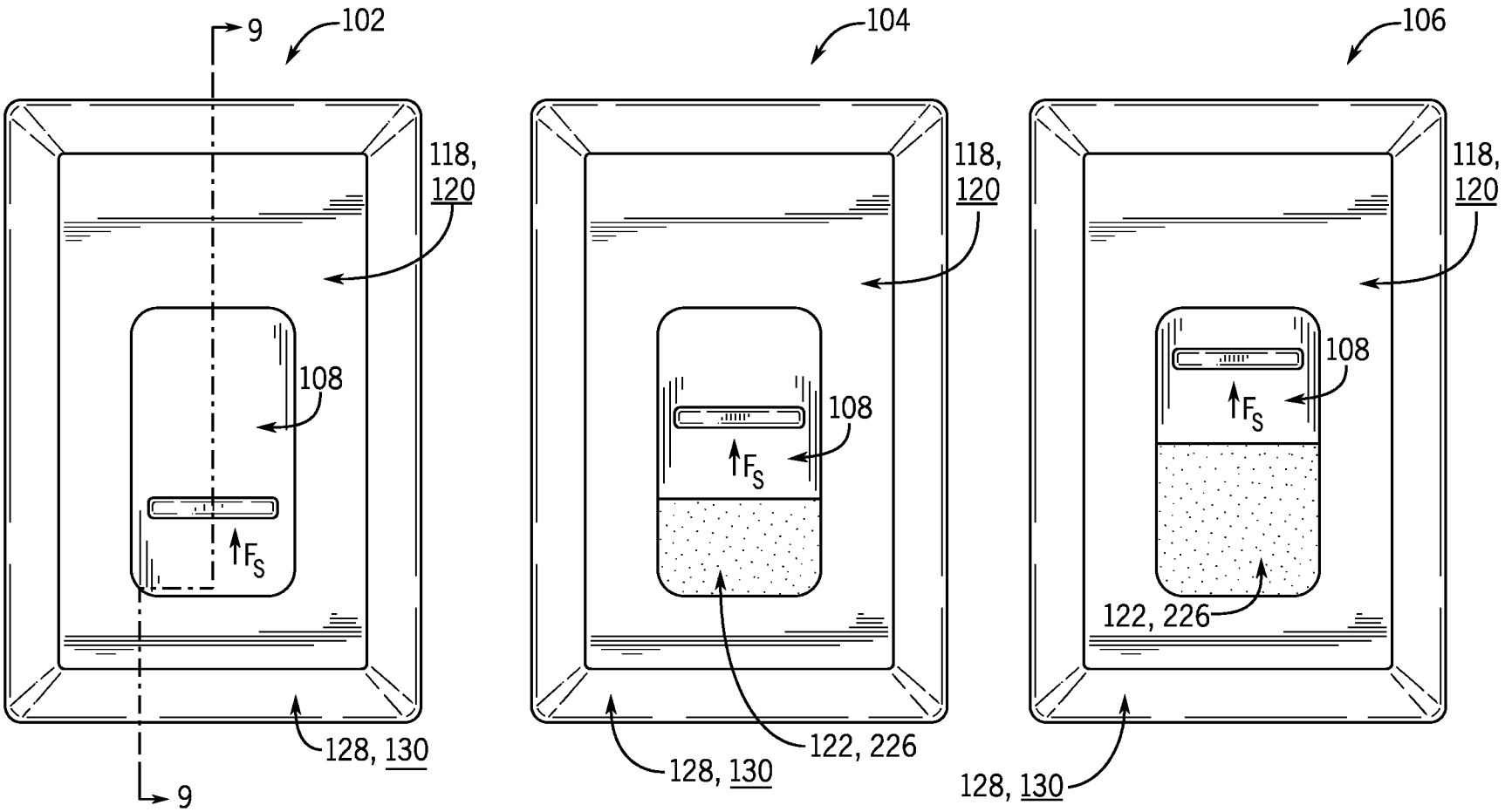
FIG. 3 is a front view of the light switch, showing the sliding member in a first position where no illumination is provided.
FIG. 4 is a front view of the light switch, showing the sliding member in a second or intermediate position exposing an extent of a light source below the sliding member.
FIG. 5 is a front view of the light switch, showing the sliding member in a third position or open position substantially exposing the entirety of the light source below the sliding member.

FIGS. 1-11 show an illuminating light switch 100 with an integrated sliding member 108 that, when actuated by a user, exposes LED lighting elements to illuminate the area where the light switch 100 is installed. The light switch 100 is configured to provide flexible illumination solutions in both stationary and portable situations. In particular, a user can releasably secure the illuminating light switch 100 to a support surface, such as a wall of a building structure, using at least one mounting member. The user can subsequently detach the switch 100 from the support surface and transport the switch 100, while illuminated or unilluminated, to another or second location that is distant from the first location to allow for portable illumination at that second location. The illuminating light switch 100 also includes multiple illumination states, where a sliding member or shutter 108 may be in: (i) a first or closed position 102 where no light is emitted from the light source 122 and in turn no light radiates from the switch 100 (FIG. 1), (ii) a second or intermediate or partially open/closed position 104 where a portion of the light that is emitted from the light source 122 radiates from the switch 100 (FIG. 4) or (iii) a third or open position 106 where all light that is emitted from the light source 122 radiates from the switch 100 (FIG. 5). As shown in FIGS. 3-5, in any of the closed, partially open or open positions, the sliding member 108, except for the protrusion 109, remains within and beneath the front member 114 of the housing 112. In this manner, the sliding member 108 is contained within the front member 114 when the user adjusts the switch 100 between the closed, open or partially open positions.

Further, the illumination state of the switch 100 may be controlled using the shutter 108, a remote, or a sensor, or any other type of input device. Accordingly, the switch 100 provides an aesthetically pleasing light switch 100 that obscures the light source 122 from view when the shutter 108 is in the fully closed position. In addition to being aesthetically pleasing, the switch 100 further provides multiple mounting configurations (e.g., coupled to a support surface via the attachment members or hand-held), multiple illumination states (e.g., "On", "Partially On", or "Off"), and multiple methods for controlling the illumination state (e.g., manual, remote, or in response to a sensor).

Figure 6:
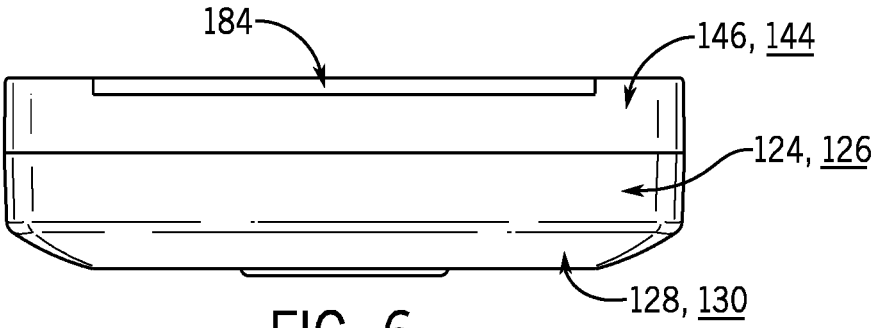
FIG. 6 is a top view of the light switch.
Figure 9:
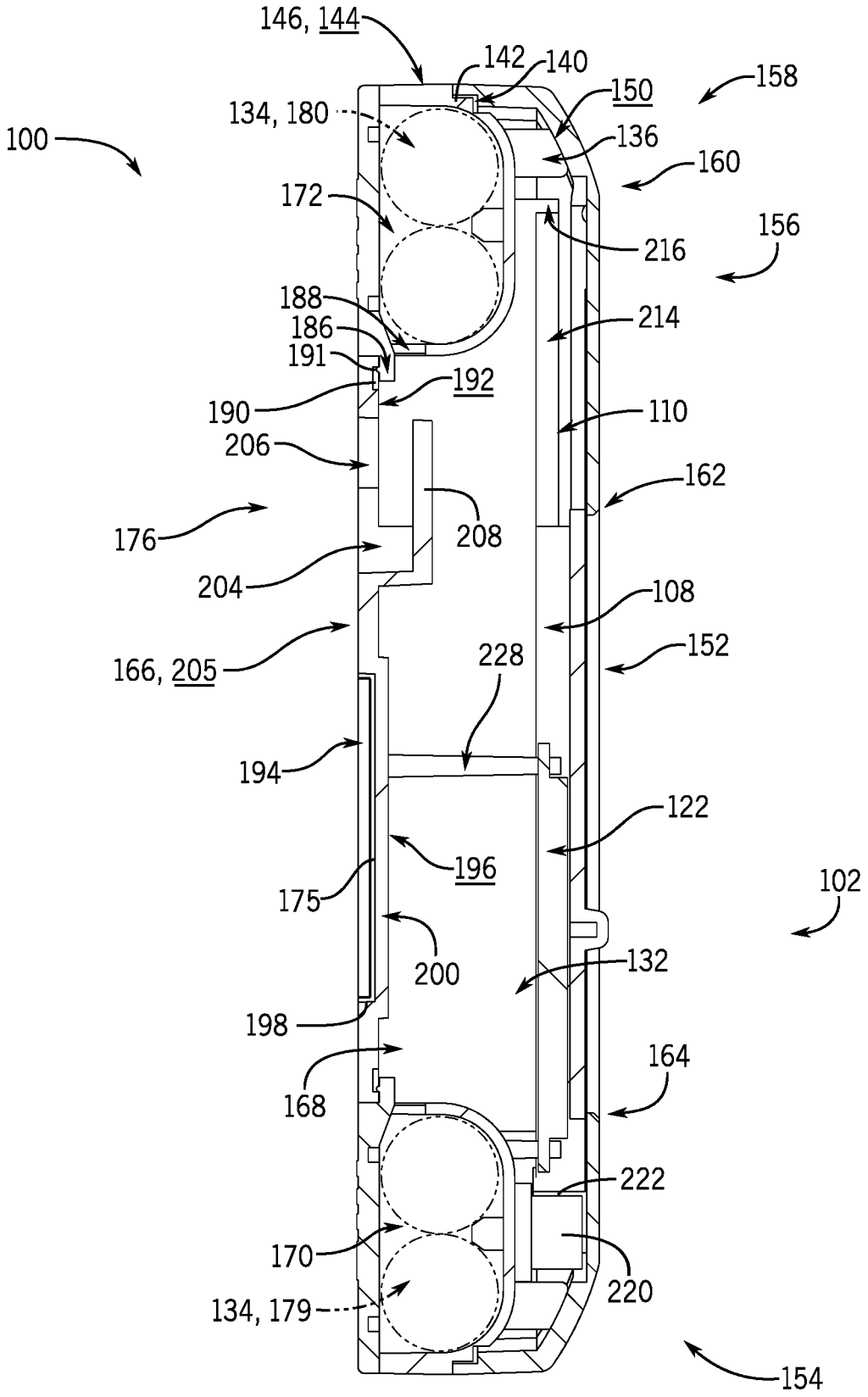
FIG. 9 is a cross-section of the light switch taken along the line 9-9 in FIG. 3.
Figure 10:
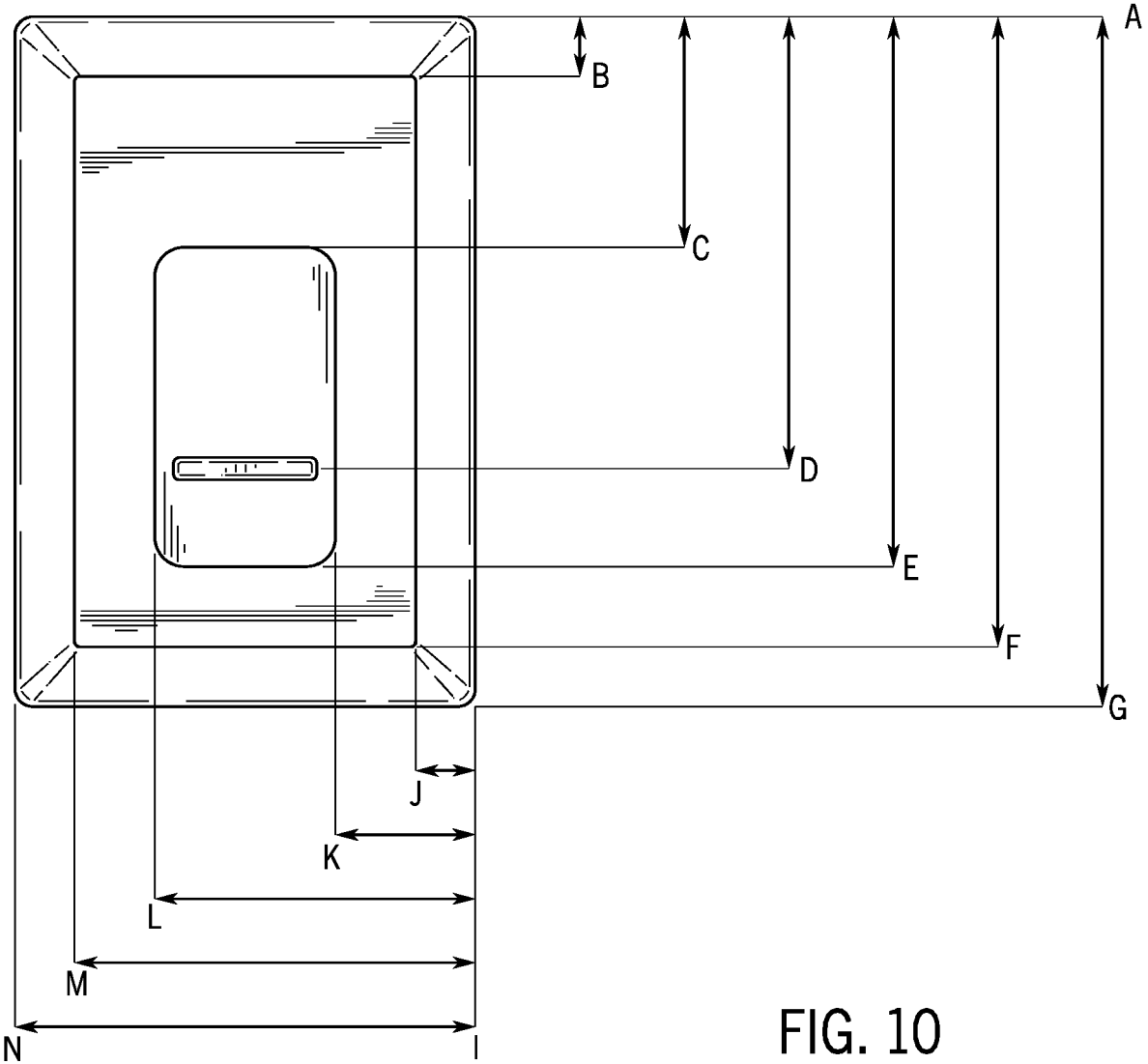
FIG. 10 is a front view of the light switch, showing the light switch in the first position.
Figure 11:
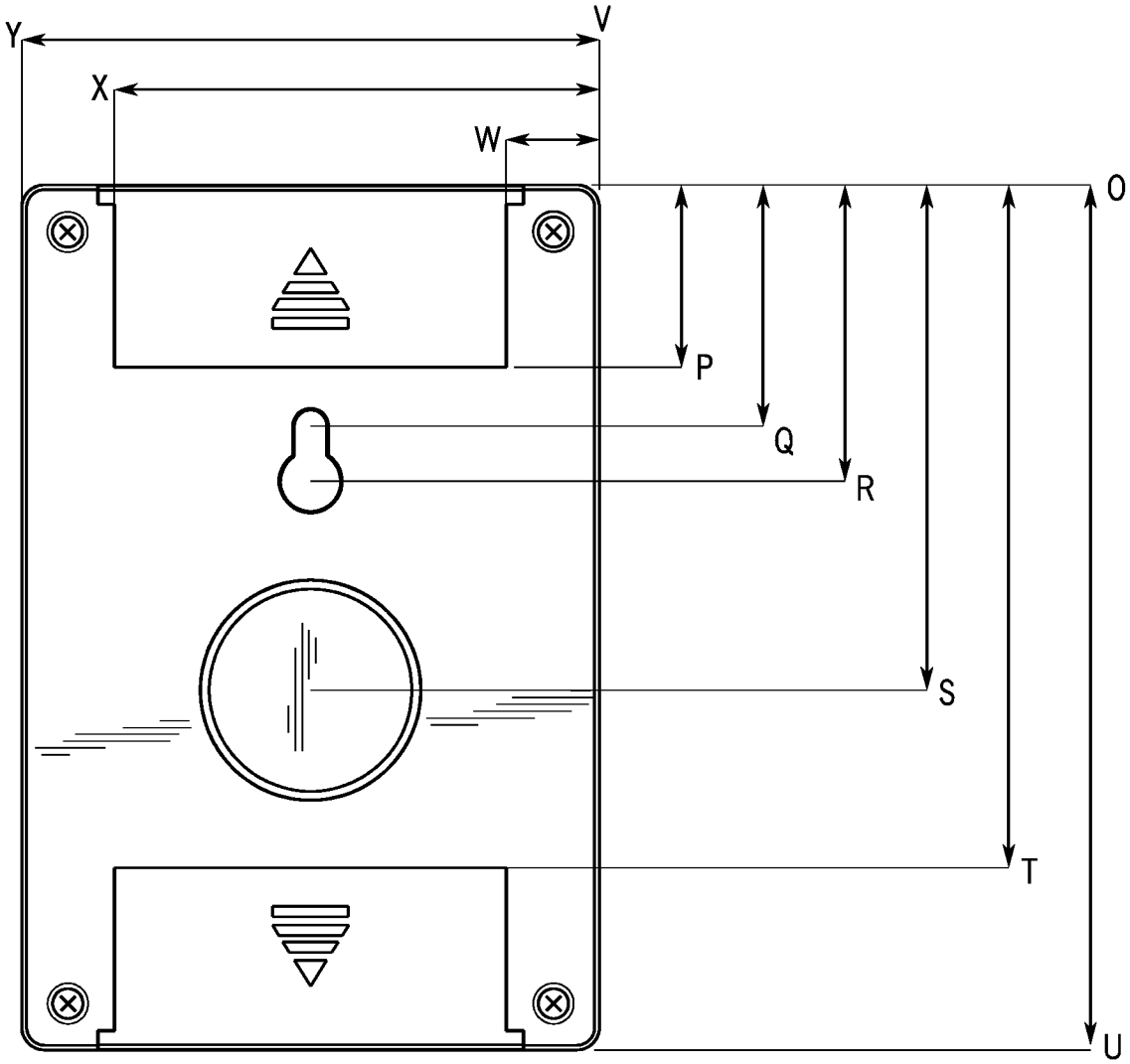
FIG. 11 is a rear view of the light switch.

As shown in FIGS. 1, 2, and 6, the switch 100 includes a housing 112, which is comprised of a front member or front plate 114 and a rear member or rear plate 116. The front member 114 of the housing 112 covers a front portion of the switch 100 and includes a number of integrally formed features, including: (i) a front wall 118 that has an outer surface 120, (ii) front side walls 124 that have outer surfaces 126, and (iii) beveled walls 128 that have outer surfaces 130, wherein the beveled walls 128 extend between the front wall 118 and the front side walls 124. The front wall 118, beveled walls 128 and front side walls 124 are arranged in a manner that creates a front recess 132 in the front member 114, as shown in FIG. 9. This front recess 132 is configured to receive at least a portion of both the light source 122 and the power source 134, when the front member 114 and the rear member 116 are coupled to one another. In the embodiment shown in FIG. 9, the entire light source 122 is positioned within the front recess 132. In other embodiments, this front recess 132 may be larger, such that both the power source 134 and light source 122 are positioned within the recess 132, or this front recess 132 may be smaller, such that only a portion of the light source 122 is positioned within the recess 132.

The front member 114 also includes recesses 140 that are formed in the innermost edge of the side walls 124. The side wall recesses 140 are configured to receive an extent of projections 142 that are formed in the rear member 116, when the front member 114 and the rear member 116 are coupled to one another. As shown in FIG. 9, the height of the projections 142 are approximately two times the width of the projection 142. A similar ratio applies to the side wall recesses 140. It should be understood that in other embodiments, the ratios for the side wall recesses 140 and projections 142 may be between 0.5 to 1 or 4 to 1. However, it should be understood that the ratios of the side wall recesses and the projections 142 should be roughly equal to ensure proper mating between the front member 114 and rear member 116. Overall, this arrangement of the side wall recesses 140 and projections 142 helps to ensure that the outer surface 126 of the front side walls 124 are aligned with the outer surface 144 of the rear side walls 146. In other embodiments, the front side walls 124 and the rear side walls 146 may be integrally formed with one another and access to the inside of the switch 100 may be provided through the rear of the switch 100.

The front member 114 further includes at least one, and preferably four, coupling member 136 to removably couple the front member 114 to the rear member 116. By removably coupling the front member 114 to the rear member 116: (i) a manufacturer can install the components, such as the light source 122, within the housing 112 or (ii) a repairman can remove the front member 114 from the rear member 116 at a date after the switch 100 was manufactured to repair a broken item contained within the switch 100. In one embodiment, the coupling member(s) 136 is connected to the inner surface 150 of the beveled walls 128. In this embodiment, the coupling member(s) 136 is a threaded post that is configured to receive an extent of an elongated coupler (e.g., a screw) 138. In other embodiments, the coupling member (s) may extend from the front side walls 124 or the front wall 118. It should be understood that in further embodiments the coupling member(s) 136 and the elongated coupler 138 could be replaced with a means for releasably securing the front member 114 to the rear member 116. For example, a first component of the releasable securement means may be a receptacle, aperture, groove or channel formed in the projection 142. This first component of the releasable securement means is cooperatively dimensioned to receive a second component of the releasable securement means, which may be a projection, pin, or tab that is positioned within the side wall recess 140. One embodiment that includes a means for releasably securing the front member 114 to the rear member 116 may be a snap or pressure fit between the front member 114 to the rear member 116. In this embodiment, the manufacturer would apply pressure on the front member 114 until the side walls 124 bent or deflect outward enough to allow the second component of the releasable securement means to overcome an extent of the projections 142. After the side walls 124 have bent or deflected outward enough to overcome an extent of the projections 142, the manufacturer continues to apply pressure on the front member 114 until the first component of the releasable securement means is seated within the second component of the releasable securement means. In even further embodiments, the positioning of the components of the releasable securement means could be reversed, such that the first component is formed in the side wall recess 140 and the second component is formed in the projection 142.

A light aperture or light opening 152 is formed in the front wall 118 of the front member 114 and sliding member 108 is configured to underlie the light aperture 152. When the sliding member is in the closed position 102, all components contained within the housing 112 are obscured (FIG. 3). This is because the sliding member 108 is larger than the light opening 152 and thus is capable of blocking the entire light opening 152. When the sliding member 108 is in the open position 106, the entirety of the light source 122 is exposed (FIG. 5). In this position, a majority of the sliding member 108 is above the light opening 152; thus, exposing the light source 122 that is aligned with the light aperture 152 and below the sliding member 108. By exposing the light source 122, the light aperture or light opening 152 allows light to radiate out of the switch 100.

As shown in FIGS. 1, 3-5 and 8-9, the light aperture 152 is not centered within the middle of the front wall 118. Instead, the light aperture 152 is shifted towards the bottom 154 of the switch 100. This configuration ensures that there is enough clearance inside the upper portion 156 of the switch 100 to allow the sliding member 108 to move towards the top 158 of the switch 100 in order to expose the light source 122. If there was not enough clearance in the top portion 156, then the light source 122 could not be fully exposed in the third or fully open position 106. In the embodiment shown in the figures, the entire height of the front wall is about 3.7 inches, the length between the top edge 160 of the front wall 118 and the top edge 162 of the light aperture 152 is about 1.1 inches, the length of the light aperture 152 is about 2.1 inches, and the length between the bottom edge 164 of the light aperture 152 and the bottom edge 164 of the front wall 118 is about 0.5 inches. Accordingly, the length above the light aperture 152 is approximately 2.2 times larger than the length below the light aperture 152. It should be understood that these dimensions and ratios may change in other embodiments, as long as the sliding member 108 can both: (i) fully cover the light source 122 in the first position 102 and (ii) substantially expose the light source 122 in the third position 106.

The rear member 116 of the housing 112 includes a number of integrally formed features. The features of the rear member 116 include: (i) a rear wall 166 and (ii) rear side walls 146. The rear wall 166 and rear side walls 146 are arranged in a manner that creates a rear recess 168 in the rear member 116, as shown in FIG. 9. The rear wall 166 also includes a number of features, such as (i) a first power source receiver 170, (ii) a second power source receiver 172, (iii) a first mounting receiver 174, (iv) a second mounting receiver 176, and (v) coupling member recesses 178. Each of these receivers (e.g., 170, 172, 174 and 176) and recesses (e.g., 178) extend inward from the rear wall 166 towards the front member 114. As such, at least an extent of these receivers and recesses (e.g., 170, 172, 174, 176 and 178) are positioned within the rear recess 168. For example, the first and second power source receivers 170 and 172 extend into and through the rear recess 168, while the first and second mounting receivers 174 and 176 are contained entirely within the rear recess 168. It should be understood that in other embodiments, this rear recess 168 may be larger, such that the power source receivers 170, 172 and light source 122 are positioned within the recess 168, or this rear recess 168 may be smaller, such that only a portion of the first mounting receiver 174 is positioned within the recess 168.

The first and second power source receivers 170, 172 are formed within the rear wall 166 and are configured to underlie an extent of the sliding member 108, when the sliding member 108 is in at least one of its positions 102, 104, 106. Additionally, the first and second power source receivers 170, 172 are designed such that they do not interfere with the operation of the sliding member 108. Further, the first and second power source receivers 170, 172 are configured to receive the power source 134, which is comprised of a first power source 179 and a second power source 180. In particular, the first power source receiver 170 receives the first power source 179 and the second power source receiver 172 receives the second power source 180. It should be understood that in other embodiments there may be fewer individual power sources 170, 172 (e.g., only a single individual power source) or there may be additional individual power sources 170, 172 (e.g., between 3 and 10 individual power sources). Once the first and second power sources 179, 180 are positioned within the first and second receivers 170, 172, a user can then enclose the power sources 179, 180 using the first and second power source covers 182, 184. The enclosure of the power sources 179, 180 within the power source receivers 170, 172 provide durability to the switch 100 and helps ensure that the power sources 179, 180 remain within the switch 100.

Figure 7:
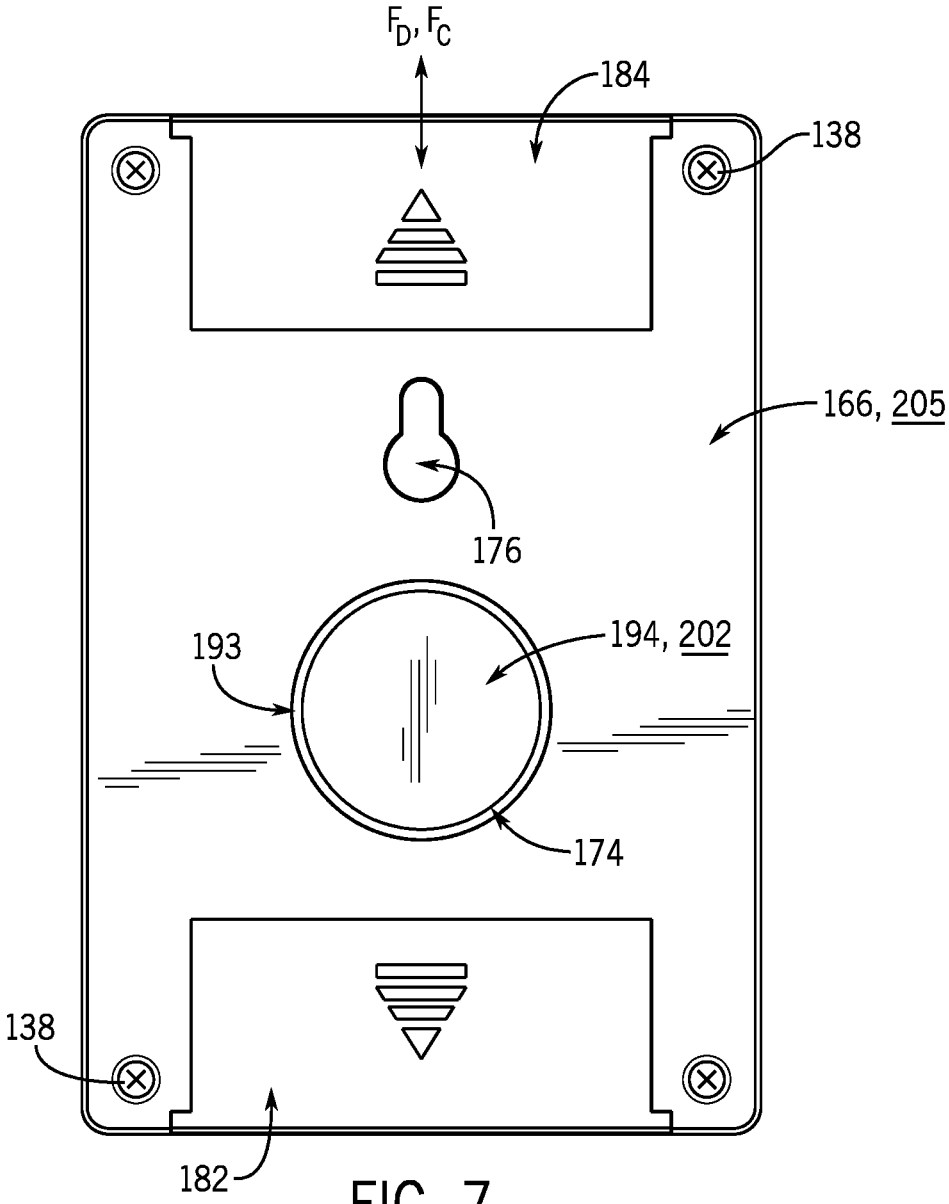
FIG. 7 is a rear view of the light switch.

Each power source cover 182, 184 include a coupling projection 186. The coupling projection 186 enables a user or operator to removably couple the power source cover 182, 184 to the rear member 116. This configuration allows the user or operator to disconnect the power source cover 182, 184 from the rear member 116 at a date after the switch 100 was manufactured to add or replace the power sources 179, 180. Specifically, the coupling projection 186 is configured to be: (i) received by an aperture 188 that is formed in the power source receiver 170, 172 and (ii) interact with a power source cover receiver 190 that is formed in the inner surface 192 of the rear wall 166. Specifically, the coupling projection 186 includes a ridge 191 that extends towards the outer surface 194. When in the connected position, as shown in FIGS. 2, 7 and 9, the ridge 191 interacts with the receiver 190 to releasably couple the power source covers 182, 184 to the rear member 116. When a user or operator decides to access the power source receivers 170, 172 to replace the power sources 179, 180, the user or operator applies a disconnection force, $F_D$, on the power source covers 182, 184 that is substantially parallel to the rear wall 166. To disconnect the power source receivers 170, 172 from the rear member 116, this disconnection force, $F_D$, must be sufficient to force the ridge 191 out of the receiver 190. It should be understood, that the user will apply an opposite force, $F_c$, that is substantially parallel to the rear wall 166 to reconnect the power source covers 182, 184 to the rear member 116. In alternative embodiments, the power source covers 182, 184 may be integrally formed with the rear wall 166. In this embodiment, the power source 134 may be inserted during the manufacture of the switch 100 and is not removable. In a further embodiment, the power source covers 182, 184 may be moved from the rear member 116 to the side walls 124, 146 that are positioned on the top and bottom 158, 154 of the switch 100.

The first mounting receiver 174 is formed within the rear wall 166 and is configured to underlie an extent of the sliding member 108, when the sliding member 108 is in at least one of its positions 102, 104, 106. Additionally, the first mounting receiver 174 is designed such that it does not interfere with the operation of the sliding member 108. Further, the first mounting receiver 174 configured to receive a first support surface attachment member 175 and a second support surface attachment member 194. The first mounting member 175 is designed to be affixed to the extent of the rear member 116, while the second support attachment member is designed to be affixed to a support surface (e.g., a wall within a building). The first and second mounting members are designed to interact with one another to releasably couple the rear member 116 and in turn the switch 100 to the support surface. This configuration enables the user to detach the switch 100 from the support surface and bring the switch 100, while illuminated or unilluminated, to another or second location that is distant from the first location to allow for portable illumination at that second location. Also, this configuration enables the user to detach the switch 100 from the support surface to replace the power source 134. Best shown in FIG. 9, both the first and second surface attachment members 175, 194 are configured to fit within the first mounting receiver 174 in a manner that ensures that the outer surface 202 of the second mounting member 194 is substantially flush with the outer surface 205 of the rear wall 166. If the outer surface 202 of the second mounting member 194 is not near or substantially flush with the outer surface 205 of the rear wall 166, then the coupling force between the support surface and the switch 100 will be reduced. Additionally, positioning the first and second mounting members 175, 194 within the first mounting receiver 174, helps to ensure that the switch 100 remains in the same position: (i) after the switch 100 has been removed and re-adhered to the support surface and (ii) after extended use, the switch 100, is not inadvertently displaced or "walk up" the support surface.

The first mounting member 175 may be permanently or semi-permanently coupled to the rear member 116 using any one of the following: (i) glue or adhesive, (ii) tabs that feed through openings formed in the attachment receiver 174 and are bent around a portion of the inner surface 196 of the attachment receiver 174, (iii) pressure fit between the outer walls 198 of the attachment receiver and the first mounting member 175, or (iv) the first mounting member 175 may be formed within the rear wall 200 of the attachment receiver 174. It should be understood that in further embodiments the first mounting member 175 could be permanently or semi-permanently coupled within the first mounting receiver 174 using a means for securing the first mounting member 175 to the rear wall 200 of the attachment receiver 174. For example, a first component of the securement means may be a receptacle, aperture, groove or channel formed in the outer walls 198 or in the rear wall 200. The first component of the securement means is cooperatively dimensioned to receive a second component of the releasable securement means, which may be a projection, pin, or tab that is positioned on the side or rear of the first mounting member 175.

The second mounting member 194 is not directly coupled to the rear member 116; but, instead is releasably coupled to the first mounting member 175. As such, a gap or channel 193 is formed between the periphery of the second mounting member 194 and the walls 198 to ensure that the second mounting member 194 can easily be removed from the first mounting receiver 174. This configuration allows the second mounting member 194 to be permanently, semi-permanently, or releasably affixed to the support surface using any one of the following: (i) glue or adhesive (e.g., peel and stick), (ii) an elongated coupler (e.g. screw or nail) that extends through a portion of the second mounting member 194, (iii) tabs or projections that extend rearward from the outer surface 202 and are configured to be received by the support surface, (iv) or any other means of permanently, semi-permanently or releasably securing the second mounting member 194 to a support surface. It should be understood that glue or adhesive used in the peel and stick embodiment is designed to: (i) sufficiently attach the second mounting member 194 to the support surface and (ii) allow for the removal of the second mounting member 194 from the support surface without damaging the support surface (e.g., paint on the surface of the drywall).

The first and second mounting members 175, 194 may be formed from a number of materials that allow the first mounting member 175 to interact with the second mounting member 194 to releasably couple the rear member 116 and in turn the switch 100 to a support surface. In one embodiment, the first mounting member 175 is a ferromagnetic disk and the second attachment member is a magnet. In this embodiment, the center strength of the magnet 194 may be between 500 Gauss and 3000 Gauss and preferably 1200 Gauss, while the edge strength of the magnet 194 may be between 1000 Gauss and 3500 and preferably 1800 Gauss. For example, the user first couples the second mounting member 194 to the support surface using a peel and stick attachment mechanism. The user may then apply a disengagement force on the switch 100 that is directed away from the support surface. This disengagement force must be sufficient to overcome the magnetic attraction force between the magnet disk 194 and the ferromagnetic disk 175. Once this magnetic attraction force between the first and second mounting members 175, 194 has been overcome, the user can remove the switch 100 from the support surface and carry the switch 100 to a second location in order to provide light in that second location.

It should be understood that the materials of the attachment members 175, 194 may be switched, such that the first mounting member 175 may be a magnet, while the second mounting member may be a ferromagnetic disk. In a further embodiment, both the first and second mounting members 175, 194 may be opposite polarity magnets. In either of these embodiments, it should also be understood that positioning of the magnet in a portion of the rear wall 116 enables the user to attach the switch 100 to a surface that is ferromagnetic without the use of the second mounting member 194. This configuration may be desirable to allow the user to: (i) remove the switch 100 from the first support surface that has the second mounting member 194 coupled thereto, (ii) carry the switch 100 to a second location, and (iii) adhere the switch 100 to a ferromagnetic object (e.g., file cabinet) in the second location in order to provide light in that second location.

In another embodiment, the first mounting member 175 is the hooked side of Velcro® and the second mounting member is the looped side of Velcro®. In a further embodiment, the first mounting member 175 is an aperture formed within the side walls 198 or the rear wall 200 and the second mounting member 194 is a projection, pin, or tab that extends away from the outer surface 202 and towards the side walls 198/rear wall 200. This projection, pin, or tab of the second mounting member 194 is cooperatively dimensioned to be received by the first mounting member 175. For example, the user couples the second mounting member 194 to the support surface using a peel and stick attachment mechanism. Then the user may apply a disengagement force on the switch 100 to disengage the projection, pin, or tab of the second mounting member 194 from the first mounting member 175. This disengagement force may be a rotational force, a lateral force (e.g., horizontal, vertical, or angled force), substantially perpendicular force, or a combination of these forces. In an even further embodiment, the first and second mounting members 194 could be replaced with a means for releasably securing the switch 100 to a support surface. For example, a first component of the releasable securement means may be a receptacle, aperture, groove or channel formed in the side walls 198 or rear wall 200. The first component of the releasable securement means is cooperatively dimensioned to receive a second component of the releasable securement means, which may be a projection, pin, or tab that extends from the support surface. In even further embodiments, the positioning of the components of the releasable securement means could be reversed, such that the first component is formed in the support surface and the second component is formed in the side walls 198 or rear wall 200.

Figure 8:
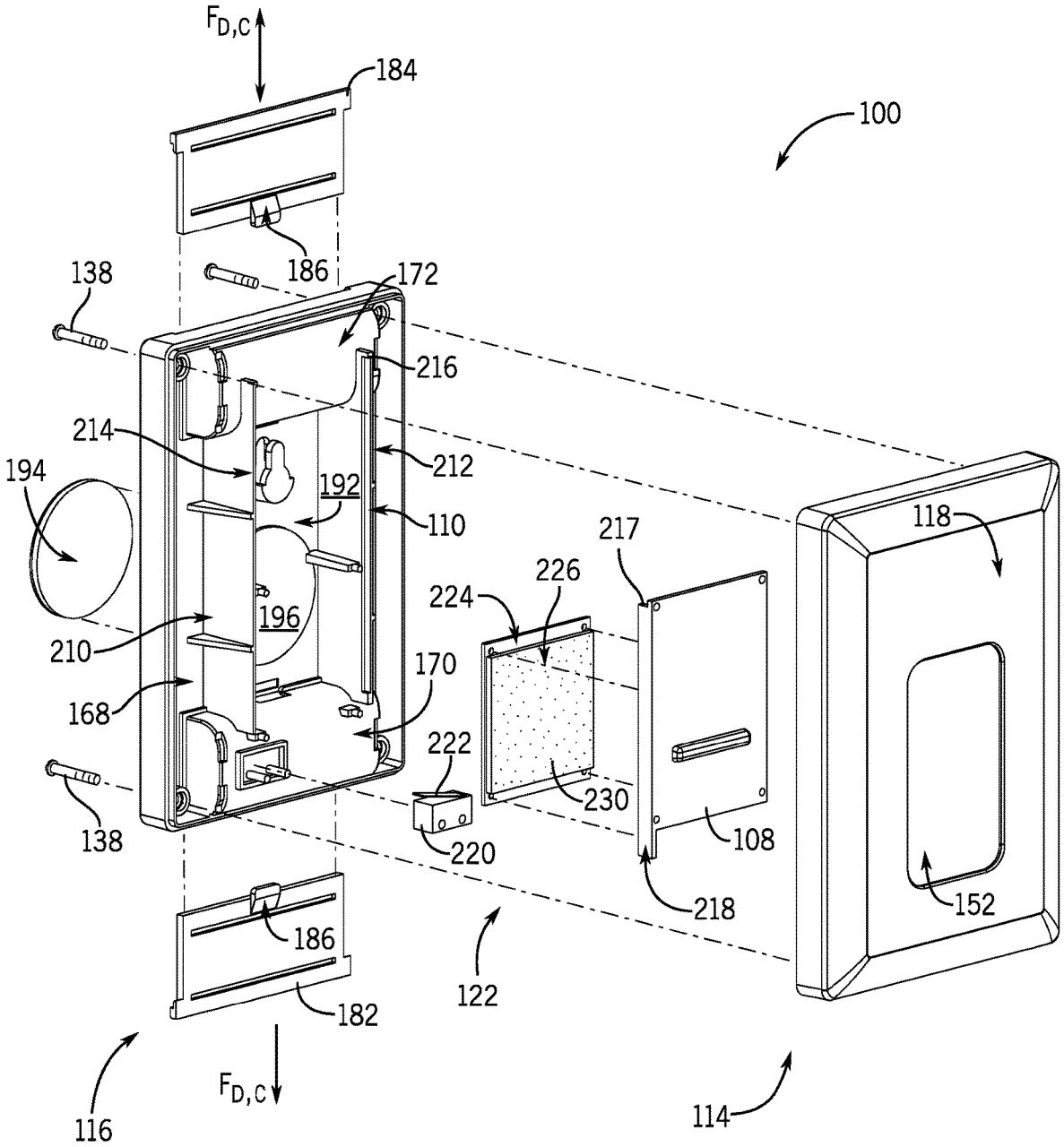
FIG. 8 is an exploded view of the light switch.

The second mounting receiver 176 is formed within the rear wall 166 and is configured to underlie an extent of the sliding member 108, when the sliding member 108 is in at least one of its positions 102, 104, 106. Additionally, the second mounting receiver 176 is designed such that it does not interfere with the operation of the sliding member 108. Further, the second mounting receiver 176 configured to receive a third mounting member (not shown). Specifically, the third mounting member is a projection (e.g., screw or nail) that is affixed to and extends outward from the support surface. As shown in FIGS. 2, 7, and 8, the second mounting receiver 176 has a first portion 204 and a second portion 206, wherein the first portion 204 has a larger opening than the second portion 206. Specifically, the first portion 204 of the second mounting receiver 176 is configured to receive both: (i) a first extent of the third mounting member (e.g., screw or nail head) and (ii) a second extent of the third mounting member (e.g., screw or nail body), while the second portion 206 of the second mounting receiver 176 receives only the second extent of the third mounting member (e.g., screw or nail body). This configuration ensures that the switch 100 is releasably coupled to the support surface, as an outward directed force cannot remove the switch 100 from the third mounting member because the first extent of the third mounting member (e.g., screw or nail head) is positioned behind an extent of the rear wall 166. Additionally, as shown in FIGS. 8 and 9, the second mounting receiver 176 has a wall 208, which helps prevent the third mounting member from entering too far into the housing 112.

As shown in FIGS. 8 and 9, the rear member 116 further includes a pair of projections 210 that extend inward from the rear wall 166 and towards the front member 112. Specifically, the pair of projections 210 have a first sliding track 212 and a second sliding track 214 formed therein. The first and second sliding tracks 212, 214 create a channel 110 that receives an extent of the sliding member 108. This channel 110 positions the sliding member 108 below the front member 114 and over the light emitter 226. This configuration enables the sliding member 108 to be positioned in the first, second and third positions 102, 104, 106, as shown in FIGS. 3-5. It should be understood that the light emitter 226 is recessed a distance below the sliding member 108 to enable the sliding member 108 to be positioned in the first, second and third positions 102, 104, 106. To cabin the movement of the sliding member 108, the first and second sliding tracks 212, 214 have an upper restrictor element 216, such as a projection or tab, that interacts with a top extent 217 of the sliding member 108 and thereby prevents the sliding member 108 form being actuated too far upward in the open position by the user. If the upper restrictor element 216 did not prevent the sliding member 108 from being pushed up too far, the user could push the sliding member 108 up to the point that causes the electronics within the housing 112 to be exposed.

At the other end, an internal switch 220 resides below the sliding member and between the front member and the rear member. The internal switch 220 is operably connected between the power source 134 and the emitter assembly 226. This configuration allows the internal switch 220 to prevent or allow current to flow from the power source 134 to the emitter assembly 226 depending on the configuration of the sliding member 108. The internal switch 220 also limits the movement of the sliding member 108 through the interaction between the internal switch 220 and the bottom extent 218 of the sliding member 108. The interaction between the sliding member 108 and the internal switch 220 will be discussed in greater detail below; but, overall when the sliding member 108 is in: (i) the first position 102, the bottom extent 218 of the sliding member 108 contacts the internal switch 220 thereby cutting or preventing the current to flow from the power source 132 to an emitter assembly 226 contained within the light source 122 and (ii) is in any other position except for the first position 102, the bottom extent 218 does not contact the internal switch 220 thereby allowing current to flow from the power source 134 to the emitter assembly 226 contained within the light source 122.

As shown in FIGS. 3-5, the application of an actuating force or a sliding force, $F_s$, can move the sliding member 108 from a first or closed position 102 (FIG. 3), through a second or intermediate or partially open/partially closed position 104 (FIG. 4), to a third or open position 106 (FIG. 5). Specifically, this actuating force, $F_s$, is applied on the protrusion 109 that extends outward from the sliding member 108 and away from the front recess 132. In the first position 102, the sliding member 108 obscures the light source 122 and the bottom extent 218 of the sliding member 108 engages with an extent 222 of the internal switch 220. When this engagement occurs, the internal switch 220 prevents current from flowing from the power source 134 to the emitter assembly 226. The user may then apply the actuating force or sliding force, $F_s$, on the protrusion 109 that extends outward from the sliding member 108 in order to move the sliding member 108 from the first position 102 towards the second position 104. In doing so, at least an extent of the light source 122 is unobscured by the sliding member 108 and the bottom extent 218 is removed from its engagement with the extent 222 of the internal switch 220. Therefore the internal switch 220 allows current to flow from the power source 134 to the emitter assembly 226. The current from the power source 134 energizes the light source 122 to cause light to be emitted by the emitter assembly 226. This light then radiates out of the light aperture 152 without being reflected or passing through an optic.

Because the sliding member 108 and the front member 114 are made from an opaque material, a limited amount of light may be permitted to radiate out of the switch 100 depending on the position of the sliding member 108. In other words, when the sliding member 108 is between the first and third positions 102, 106, not all of the light that is emitted from the light source 122 is permitted to radiate out of the switch 100. Thus, as the sliding member 108 is moved to a position that unobscures more of the light source 122, more light is permitted to radiate outside of the switch 100.

As a result, the position of the sliding member 108 and the corresponding proportion of the opening 152 occluded thereby may provide a variable light output. In this way, the sliding member 108 may act as a mechanical dimmer wherein more illumination is emitted through the opening 152 the further the sliding member 108 is pushed towards the third position 106. Conversely, the further the sliding member 108 is pushed towards the first position 102, a smaller proportion of the light source 122 is exposed and, thusly, less light radiates from the switch 100.

In alternative embodiments, the light source 122 may not emit light until the sliding member 108 reaches the third or fully open position 106. In another embodiment, portions of the light source 122 may be sequentially energized as the sliding member 108 is moved from the first or fully closed position 102 to the third or fully open position 106. In this embodiment, portions of the light source 122 are energized when the sliding member 108 passes the respective elements while moving towards the third position 106, such that the exposed portion of the light source 122 is energized, while the unexposed portion of the light source 122 is not energized. In this manner, the sliding member 108 acts not only as a mechanical dimmer; but, also the sliding member 108 acts as an electrical dimmer. It should be understood that other and/or additional circuit elements, such as the ones discussed below, may alter the above-described illumination characteristics.

Also, while the figures show that the sliding member 108 is configured to move vertically along channel 110, it should be understood that in other embodiments the sliding member may move in a different direction. For example, the sliding member 108 may slide laterally/horizontally within complementarily situated sliding tracks. In further examples, the sliding member 108 may slide circularly, at an angle, or any combination of these directions.

Referring to FIG. 8, the light source 122 includes: a lighting element printed circuit board ("PCB") 224, an emitter assembly 226, and the internal switch 220. The lighting element PCB 224 is positioned inward from the emitter assembly 226 and the sliding member 108. Specifically, the lighting element PCB 224 is positioned between the pair of projections 210 on at least one, and preferably four, lighting element PCB mounting posts 228. These mounting posts 228 elevate the lighting element PCB 224 over an extent of the first mounting receiver 174, but below the sliding member 108. This position ensures that the sliding member 108 does not contact the lighting element PCB 224 or the emitter assembly 226, while aiding in the heat distribution as air can flow under the lighting element PCB 224. The lighting element PCB 224 contains the necessary circuitry (e.g., fixed resistors, variable resistors, capacitors, inductors, diodes, or other similar components) to receive electrical current from the power source 134 and supply the received electrical current to the emitter assembly 226.

The emitter assembly 226 is positioned adjacent to and in contact with the lighting element PCB 224 and inward from the sliding member 108. The emitter assembly 226 is composed of between 1 and 500 individual emitters 230, preferably between 25 and 75 individual emitters 230, and most preferably between 40 and 60 individual emitters 230. The emitter assembly 226 may produce between 0 and 2000 lumens, preferably between 0 and 1000 lumens, and most preferably between 0 and 800 lumens. As discussed above, in certain embodiments every individual emitter 230 contained within the emitter assembly 226 may be illuminated when power is applied from the internal switch 220, while in other embodiments a subset of the individual emitters 230 contained within the emitter assembly 226 may be illuminated when power is applied from the internal switch 220. While each individual emitter 230 may be illuminated, the emitter assembly 226 may limit the amount of electrical current that is supplied to the individual emitters 230 in order to regulate the amount of light that radiates from the switch 100. For example, the user may use a dial, button, switch, remote, of sound to set the brightness of the light. This setting may then be used by the emitter assembly 226 to determine the amount of current that should be supplied to the individual emitters 230 to produce the desired light level.

The emitter assembly 226 may be a Chip on Board ("COB") LED or surface-mount device LED. If the emitter assembly 226 is a COB LED or a surface-mount device LED, then the switch 100 does not have a primary optic nor does it have a secondary optic. This is due to the fact that the switch 100 does not have a lens that covers the emitter assembly 226 and the individual light emitters in a COB LED or surface-mount device LED do not have optics. Thus, light that is emitted from the emitter assembly 226 passes directly out of the switch 100 without going through a lens. Additionally, substantially all of the light in this embodiment is not reflected prior to leaving the switch 100 because: (i) the emitter assembly 226 is aligned with the light aperture 152, (ii) the emitter assembly 226 is positioned near the light aperture 152 in the front member, and (iii) the switch 100 does not contain a reflector that is positioned between the emitter assembly 226 and the light aperture 152. This configuration helps minimize the amount of light that is lost due to absorption prior to the light being allowed to exit the switch 100.

It should be understood that in other embodiments, a lens, transparent housing, plastic film, diffuser plate, and/or another suitable protective layer that covers all, or a majority, of the light emitters 226 may be included in the switch 100 in combination with a COB LED or surface-mount device LED. In this embodiment, there is a first optic, which is the lens, transparent housing, plastic film, diffuser plate, and/or another suitable protective layer, but there is no secondary optic. In further embodiments, the switch 100 may include a reflector that is positioned between the emitter assembly 226 (e.g., COB LED or surface-mount device LED) and the light aperture 152 to aid in or modify the light distribution. In even further embodiments, the switch 100 may include a COB LED or surface-mount device LED in combination with both a reflector and a lens, transparent housing, plastic film, diffuser plate, and/or another suitable protective layer that covers all, or a majority, of the light emitters 226.

Instead of a COB LED or surface-mount device LED, the emitter assembly 226 may be: (i) a standard LED, (ii) organic LED, (iii) induction light panel, (iv) silicon quantum dot phosphor (SiQD-phosphor), or (v) other types of known light emitters. For example, if standard LEDs are used, instead of a COB LED or a surface-mount device LED, then the switch 100 would include a first optic as each standard LED includes an optic. Additionally, in this configuration, the manufacturer may desire to include a lens, transparent housing, plastic film, diffuser plate, and/or another suitable protective layer that covers all of the light emitters 226 to aid in the light distribution and to protect the LEDs from the surrounding environment. Thus, if a lens is utilized in connection with standard LEDs, then the switch 100 will have two optics, a first optic that encloses each individual emitter 230 and a second optic that overlays a plurality of individual emitters 230. The lens, transparent housing, plastic film, diffuser plate, and/or another suitable protective layer that covers all, or a majority, of the light emitters 226 may have a cross-sectional shape that is: (i) substantially rectangular, (ii) convex, or (iii) concave. This cross-sectional shape may be chosen based on the desired light distribution and the type of emitter assembly 226.

As shown in FIG. 9, outer surface 120 of the front member 118 resides in a first substantially horizontal plane that is parallel with a second substantially horizontal plane that the sliding member 108 resides within. The emitter assembly 226 resides a third substantially horizontal plane that is parallel with the fourth substantially horizontal plane that the outer surface 205 of the rear wall 166 resides within. Accordingly, the second and third substantially horizontal planes are positioned within the first and fourth substantially horizontal planes. In other embodiments, the first and fourth substantially horizontal planes may not be parallel to one another. In this embodiment, the second and third substantially horizontal planes may be positioned parallel to the first and not the fourth substantially horizontal planes. In further embodiments, some or none of the substantially horizontal planes may be parallel to one another.

In other embodiments, there may be multiple emitter assemblies 226. Specifically, there may be between 1 and 10 emitter assemblies 226. For example, there may be a first emitter assembly and a second emitter assembly, where the first emitter assembly is configured to light up a portion of the room by outputting between 100 lumens and 400 lumens and the second emitter assembly is configured to be a night light and output between 10 lumens and 50 lumens. Also, in this embodiment, the first emitter assembly outputs white colored light, while the second emitter assembly outputs blue colored light. In embodiments where there are multiple emitter assemblies 226, there will be multiple sliding members 108. Preferably, there will be one sliding member 108 per emitter assembly 226. Alternatively, one sliding member 108 may be associated with two or more emitter assemblies 226, where sliding the member 108 in one direction will illuminate one emitter assembly 226 and moving the sliding member 108 in the other direction will illuminate the other emitter assembly 226.

Further, in other embodiments, the emitter assembly 226 may include multiple individual emitters 230 that are different colors. For example, the individual emitters 230 may be white, red, green, blue, yellow, or any other color. The switch 100 can then alternate the amount of current that is applied to each individual emitter 230 using a pulse modulation technique or other similar technique to alter the color of light that is emitted from the switch 100. In particular, in one embodiment the emitter assembly 226 may have a first set of individual emitters 230 that only emit white light and a second set of individual emitters 230 that emit red, green and blue light. In this embodiment, the switch 100 can supply current to the white light emitters 230 in a first state and can supply a modulated current to the red, green and blue light emitters 230 in a second state. In these embodiments that include individual emitters 230 that emit colored light, it should be understood that the select colors may be preprogrammed into the switch 100 during the manufacture of the switch 100, such that the user can select one of the preprogrammed light colors (e.g., orange, teal, or etc.). In other embodiments that include individual emitters 230 that emit colored light, it should be understood that a basic set of colors may be preprogrammed into the switch 100 during the manufacture of the switch 100, but the switch 100 may also include a light sensor that provides a feedback loop for altering the color of the light depending the switches environment.

The power source 134 provides electrical power to the switch 100 and specifically to the light source 122. In particular, the power source 134 may be a combination of removable non-rechargeable batteries. Preferably, the power source 134 is a combination of removable non-rechargeable AA batteries, as shown in FIG. 9. It should be understood that different configurations of the batteries may be implemented. For example, the batteries may be larger batteries, such as C or D sized batteries, or smaller batteries, such as AAA. It should also be understood that instead of being a combination of removable non-rechargeable batteries, the power source 134 may be a single removable non-rechargeable battery, a single removable rechargeable battery, a combination of removable rechargeable batteries, a combination of removable rechargeable batteries disposed within a battery cartridge, a single non-removable rechargeable battery, a combination of non-removable rechargeable batteries, solar cell or any other type of portable power source that is known to a person of skill in the art.

It should be understood that other circuitry may be included within the switch 100, such as a microcontroller. A microcontroller may be operatively connected with one or more sensors, the internal switch 220, and/or other input devices. According to an example embodiment of the illuminating light switch 100, a motion sensor may be coupled to the light source 122. In accordance with this example embodiment, the light source 122 may illuminate upon the detection of motion, regardless of the position of the sliding member 108 is in the first or fully closed position 102. Upon this detection of motion, the microcontroller may set a timer that turns off the light source 122 after a predefined amount of time. Alternatively, the sensor may be a light sensor that only allows current to be supplied to the light emitter assembly 226 if both: (i) light sensors detect a limited amount of light and (ii) the sliding member 108 is in a position other than the first position 102. In other embodiments, in addition to internal switch 220 or in replacement of internal switch 220, the switch 100 may be configured to utilize one or more buttons, switches, sliders, local sensors (e.g., motion, light, sound, heat, smoke, carbon monoxide), remote sensors (e.g., cell phone, laptop, RF remote control, remote devices described in U.S. patent application Ser. No. 15/812,852, and which is fully incorporated herein by reference, or other devices that are connected to the switch 100 via the internet (e.g., wireless camera, motion sensor, light sensor, timer, etc.).

The embodiment(s) detailed hereinabove may be combined in full or in part, with any alternative embodiment(s) described. The above disclosure may represent an improvement in the art because an aesthetically pleasing light fixture that obscures unattractive light source elements, such as LED modules, when same are not in use may represent an improvement in the art. Further, the operation of the sliding member detailed hereinabove is an intuitive and attractive method of providing a lighting solution. While some implementations have been illustrated and described, numerous modifications come to mind without significantly departing from the spirit of the disclosure, and the scope of protection is only limited by the scope of the accompanying claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Other implementations are also contemplated.

While some implementations have been illustrated and described, numerous modifications come to mind without significantly departing from the spirit of the disclosure; and the scope of protection is only limited by the scope of the accompanying claims. For example, the overall shape of the switch 100 may be altered to be any one of the following shapes, as long as the shape does not interfere with the sliding member's 108 operation: a triangular prism, cylinder, cube, pentagonal prism, hexagonal prism, octagonal prism, sphere, cone, tetrahedron, dodecahedron, icosahedron, torus, ellipsoid, hemisphere, or any other similar shape. In addition, the shape of the sliding member 108 may be altered to have an exterior appearance that matches any of the following shapes, as long as the shape does not interfere with its operation: a circle, square, oval, trapezoid, rhombus, kite, triangle, pentagon, hexagon, octagon, nonagon, decagon, star, heart, cross, pie, arrow, crescent, or any other similar shape. It should be understood that the shape of the sliding member 108 may match the overall shape of the switch 100 or it may be different.

The shape of the first mounting receiver 174 and the second mounting receiver 176 may be altered to be any one of the following shapes: a triangular prism, cylinder, a cube, a pentagonal prism, a hexagonal prism, octagonal prism, sphere, a cone, a tetrahedron, a dodecahedron, a icosahedron, a torus, a ellipsoid, hemisphere, or any other similar shape. However, it should be understood that if the shape of the first mounting receiver 174 is altered, the shape of at least the second support surface attachment member 194 should be altered to fit within the first mounting receiver 174. Additionally, it should be understood that if the shape of the second mounting receiver 176 is altered, the shape of the third support surface attachment member should be altered to fit within the second mounting receiver 176.

The switch 100 may have various frontal lengths. For example, the first frontal length that extends between A and B, shown in FIG. 10, may vary between 1.5 inches and 0.2 inches and is preferably 0.4 inches, while the second frontal length that extends between A and C, shown in FIG. 10, may vary between 4.5 inches and 0.75 inches and is preferably 1.5 inches. The third frontal length that extends between A and D, shown in FIG. 10, may vary between 8.7 inches and 1.6 inches and is preferably 3 inches, while the fourth frontal length that extends between A and E, shown in FIG. 10, may vary between 10.7 inches and 1.8 inches and is preferably 3.5 inches. The fifth frontal length that extends between A and F, shown in FIG. 10, may vary between 12.3 inches and 2 inches and is preferably 4 inches, while the sixth frontal length that extends between A and G, shown in FIG. 10, may vary between 13.4 inches and 2.2 inches and is preferably 4.5 inches. The switch 100 may have a various width. For example, the first frontal width that extends between I and J, shown in FIG. 10, may vary between 1 inch and 0.17 inches and is preferably 0.35 inches, while the second frontal width that extends between I and K, shown in FIG. 10, may vary between 2.6 inches and 0.4 inches and is preferably 1.5 inches. The third frontal width that extends between I and L, shown in FIG. 10, may vary between 6.24 inches and 1 inch and is preferably 2 inches, while the fourth frontal width that extends between I and M, shown in FIG. 10, may vary between 7.7 inches and 1.3 inches and is preferably 2.6 inches. The fifth frontal width that extends between I and N, shown in FIG. 10, may vary between 8.8 inches and 1.5 inches and is preferably 3 inches.

The switch 100 may have various lengths. For example, the first rear length that extends between O and P, shown in FIG. 11, may vary between 2.7 inches and 0.5 inches and is preferably 0.9 inches, while the second rear length that extends between O and Q, shown in FIG. 11, may vary between 3.7 inches and 0.6 inches and is preferably 1.2 inches. The third rear length that extends between O and R, shown in FIG. 11, may vary between 4.6 inches and 0.8 inches and is preferably 1.5 inches, while the fourth rear length that extends between O and S, shown in FIG. 11, may vary between 7.8 inches and 1.3 inches and is preferably 2.6 inches. The fifth rear length that extends between O and T, shown in FIG. 11, may vary between 10.6 inches and 1.75 inches and is preferably 3.5 inches, while the sixth rear length that extends between O and U, shown in FIG. 11, may vary between 13.4 inches and 2.2 inches and is preferably 4.5 inches. The switch 100 may have a various width. For example, the first width that extends between V and W, shown in FIG. 11, may vary between 1.4 inch and 0.23 inches and is preferably 0.46 inches, while the second width that extends between V and X, shown in FIG. 11, may vary between 7.5 inches and 1.25 inches and is preferably 2.5 inches. The third rear width that extends between V and Y, shown in FIG. 11, may vary between 8.8 inches and 1.5 inches and is preferably 3 inches.

The housing 112 may be formed from (i) metal, such as aluminum or steel, (ii) a polymer material, such as plastic, (iii) a magnetic material, (iv) a material that glows in the dark or (v) a combination of the prior material. The housing 112 and sliding member 108 may be formed using injection molded or 3D printing and may be a solid color (e.g., white, off-white, beige, or sand) that is intended to blend into a typical wall in a house, may be multiple colors, or may be paintable. Further, the outer surface of the housing 112 may include indicia, such as the manufacturer of the switch 100 or may be personalized to include a person's name or information. Moreover, the outer surface of the power source covers 182, 184, may have indicia that informs how to remove the power source covers 182, 184 from the rear member 116. Also, the outer surface of the sliding member 108 may also have indicia that informs how to move the sliding member from a closed position 102 to an open position 106.

Headings and subheadings, if any, are used for convenience only and are not limiting. The word exemplary is used to mean serving as an example or illustration. To the extent that the term includes, have, or the like is used, such term is intended to be inclusive in a manner similar to the term comprising as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. An illuminating light switch removably affixed to a support surface, comprising:

a housing having a first end and a second end, said housing including:

a front member that includes a light aperture, wherein a distance between said light aperture and the second end is less than a distance between said light aperture and the first end;

a rear member that includes a first mounting receiver configured to receive and encase an extent of: (i) a first mounting member that is coupled to an extent of the rear member and (ii) a second mounting member adapted to be coupled to the support surface; and a pair of internal projections that form a channel;

a sliding member, wherein the sliding member is movable along the channel between a closed position and an open position;

a light source disposed between an extent of the rear member and the sliding member;

at least one battery operably connected to an internal switch to selectively supply power to the light source, said battery is positioned in the housing;

wherein in the closed position, the sliding member obscures the light source and engages the internal switch, wherein said internal switch does not supply power to the light source for illumination; and wherein in the open position, the sliding member: (i) exposes at least an extent of the light source, (ii) does not expose a structure positioned between the light source and the first end, and (iii) disengages from the internal switch, wherein said internal switch supplies power to the light source for illumination through the light aperture without passing through an additional optic.

2. The illuminating light switch of claim 1, wherein an actuating force is applied to a protrusion of the sliding member to move the sliding member from the closed position to the open position.

3. The illuminating light switch of claim 2, wherein the light source is a positioned adjacent to the sliding member and is a Chip-on-Board light emitting diode.

4. The illuminating light switch of claim 1, wherein the first mounting member is a ferromagnetic disk and the second mounting member is a magnet, wherein the magnetic attraction between the first mounting member and the second mounting member releasably attaches the illuminating light switch to the support surface.

5. The illuminating light switch of claim 4, wherein the illuminating light switch can be removed from the support surface by an application of a disengagement force that is both directed away from the support surface and greater than the magnetic attraction between the first mounting member and the second mounting member.

6. The illuminating light switch of claim 1, wherein the sliding member overlies the light source and underlies the light aperture, and wherein an extent of the battery is positioned between the sliding member and the rear member.

7. The illuminating light switch of claim 1, wherein in an intermediate position, the sliding member partially obscures the light source whereby (i) a portion of the light that is emitted from the light source passes through the light aperture and (ii) a portion of the light that is emitted from the light source does not pass through the light aperture.

8. The illuminating light switch of claim 1, wherein the housing includes a first power source receiver located in a lower portion of the housing, and wherein said first power source receiver is configured to receive the at least one battery.

9. The illuminating light switch of claim 8, wherein the housing includes a second power source receiver located in a upper portion of the housing, and wherein said second power source receiver is configured to receive a least one battery.

10. An illuminating light switch removably affixed to a support surface, the light switch comprising:

a housing including a front member that includes a light aperture and a rear member joined to the front member, the rear member including a first mounting receiver that receives an extent of a first mounting member;

a second mounting member adapted to be coupled to both the support surface and the first mounting member;

a sliding member operably connected to at least one internal channel of the housing, wherein the sliding member is movable along the channel between a closed position, an intermediate position and an open position;

a light source disposed between an extent of the rear member and the sliding member, the light source being aligned with the light aperture;

at least one power source operably connected to an internal switch to selectively supply current to the light source, said at least one power source is positioned in the housing;

wherein in the closed position, the sliding member obscures the light source and the internal switch does not supply current from the power source to the light source for illumination;

wherein in the intermediate position, the sliding member partially exposes a first extent of the light source and the internal switch supplies current from the power source to only the first extent of the light source for illumination through the light aperture without passing through an additional optic; and, wherein in the open position, the sliding member exposes a second extent of the light source and the internal switch supplies current from the power source to both the first and second extents of the light source for illumination through the light aperture without passing through an additional optic.

11. The illuminating light switch of claim 10, wherein an actuating force is applied to a protrusion of the sliding member to move the sliding member along the channel between the closed, intermediate and open positions.

12. The illuminating light switch of claim 10, wherein the first mounting member is a ferromagnetic disk and the second mounting member is a magnet, wherein the magnetic attraction between the first mounting member and the second mounting member releasably attaches the illuminating light switch to the support surface.

13. The illuminating light switch of claim 12, wherein the illuminating light switch can be removed from the support surface by an application of a disengagement force that (i) is directed away from the support surface and (ii) is greater than the magnetic attraction between the first mounting member and the second mounting member.

14. The illuminating light switch of claim 10, wherein the power source is a battery, said battery allows the illuminating light switch to be brought by a user to a second location that is distant from the support surface and to provide illumination in said second location.

15. The illuminating light switch of claim 10, wherein the housing includes a first power source receiver located in a lower portion of the housing, and a second power source receiver located in an upper portion of the housing.

16. The illuminating light switch of claim 15, wherein the power source includes (i) at least one battery that resides within the first power source receiver, and (ii) at least one battery that resides with the second power source receiver.

17. An illuminating light switch removably affixed to a support surface, comprising:

a housing including:

a front member that includes a light aperture;

a rear member removably coupled to the front member;

a sliding member having a projection;

at least one internal elongated channel, wherein the sliding member is movable along the channel between a closed position and an open position;

an internal light source disposed between an extent of the rear member and an extent of the sliding member;

an internal switch configured to be placed in either a off state or an on state, said internal switch is positioned between a battery receiver and the front member;

at least one battery positioned within the battery receiver and operably connected to the internal switch to selectively supply power to the light source;

wherein in the closed position, the sliding member obscures the light source and the projection of the sliding member engage an extent of the switch to place the switch in an off position, wherein said internal switch does not supply power to the light source for illumination; and wherein in the open position, the sliding member exposes at least an extent of the light source and the projection of the sliding member disengages the extent of the switch to allow the switch to move to an on position, wherein said internal switch supplies power to the light source for illumination through the light aperture.

18. The illuminating light switch of claim 17, wherein the rear member includes a first mounting receiver configured to receive an extent of: (i) a ferromagnetic disk that is coupled to an extent of the rear member and (ii) a magnet adapted to be coupled to the support surface; and wherein the magnetic attraction between the first mounting member and the second mounting member releasably attaches the illuminating light switch to the support surface.

19. The illuminating light switch of claim 17, further comprising a sensor that is configured to bypass the internal switch to illuminate the light source when the sensor is triggered.

20. The illuminating light switch of claim 17, wherein the housing has a first end and a second end, and wherein a distance between said light aperture and the second end is less than a distance between said light aperture and the first end.

* * * * *